United States Patent [19]

Palm

[11] Patent Number: 4,530,341

[45] Date of Patent: Jul. 23, 1985

[54] PISTON ENGINE HAVING AT LEAST ONE HEAT-INSULATED COMBUSTION CHAMBER, AND PARTS FOR SAID ENGINE

[75] Inventor: Bengt N. J. Palm, Nykvarn, Sweden

[73] Assignee: Saab-Scania Aktiebolag, Sodertalje, Sweden

[21] Appl. No.: 516,189

[22] Filed: Jul. 22, 1983

Related U.S. Application Data

[63] Continuation of Ser. No. 198,066, Oct. 17, 1980, abandoned.

[30] Foreign Application Priority Data

Oct. 22, 1979 [SE] Sweden ..... 7908739

[51] Int. Cl.[3] ..... F02B 75/08

[52] U.S. Cl. ..... 123/669; 123/193 P; 123/193.11

[58] Field of Search ..... 123/193 R, 193 P, 193 H, 123/657, 668, 669

[56] References Cited

U.S. PATENT DOCUMENTS

| | | | |
|---|---|---|---|
| 1,490,849 | 4/1924 | Philip | 123/193 P |
| 3,730,163 | 5/1973 | Elsbett et al. | 123/193 P |
| 3,820,523 | 6/1974 | Showalter et al. | 123/669 |
| 4,074,671 | 2/1978 | Pennila | 123/668 |
| 4,242,948 | 1/1981 | Stang et al. | 123/193 P |
| 4,245,611 | 1/1981 | Mitchell et al. | 123/669 |

FOREIGN PATENT DOCUMENTS

| | | | |
|---|---|---|---|
| 2729230 | 1/1979 | Fed. Rep. of Germany | 123/668 |
| 570238 | 4/1924 | France . | |
| 0778119 | 3/1935 | France | 123/193 P |
| 203338 | 4/1924 | United Kingdom . | |
| 1465724 | 3/1977 | United Kingdom . | |

*Primary Examiner*—Craig R. Feinberg

*Attorney, Agent, or Firm*—Cushman, Darby & Cushman

[57] ABSTRACT

Improved heat insulating of a combustion chamber in an internal combustion engine is obtained by providing a heat-resistant body in at least one surface, which is intended to at least partly limit a combustion chamber. A support body supports the heat-resistant body, said bodies each having facing mantle surfaces. Between said bodies there is a heat-insulating element of a material having a lower coefficient of thermal expansion and a lower modulus of elasticity than the material in either one of said bodies. The bodies and the element are held together at the mantle surfaces by means of a shrink fit.

9 Claims, 5 Drawing Figures

Figure 1:
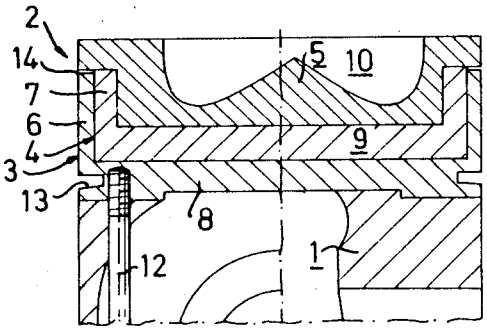

PISTON ENGINE HAVING AT LEAST ONE HEAT-INSULATED COMBUSTION CHAMBER, AND PARTS FOR SAID ENGINE

This is a continuation of application Ser. No. 198,066, filed Oct. 17, 1980, now abandoned.

The present invention relates to a piston engine with at least one cylindrical combustion chamber limited by at least one wall portion comprising a support body with at least one mantle surface radially directed relative the cylinder axis, said surface facing a corresponding surface on a heat-resistant body limiting the combustion chamber.

For reducing heat losses during combustion in an engine, it is previously known to limit the combustion chambers of such an engine by means of bodies of heat-resistant material, and especially it is known to provide a piston with heat-resistant wall portions. Thus, the U.S. Pat. No. 1,490,849 teaches a piston engine where the piston is provided with a heat-insulating piston crown which together with an intermediate metal element is integrated in a recess at one end of the piston body.

However, said solution is not satisfactory for modern internal combustion engines, since heat-insulating materials known up to now do not have the mechanical strength required to stand the loads occurring during the combustion cycle at the high temperatures at which combustion takes place.

It is also known from the Swedish patent specification No. 7714878-1 to use a ceramic material in a piston crown, the material having such a mechanical strength as to withstand mechanical loads also at the high temperatures obtained during combustion. The top of the piston rests on a heat-insulating plate and is attached to the piston body by separate attachment means. Said means cause spot loads, however, and thereby cause stress concentrations in the piston top, which leads to crack formation in the brittle ceramic material.

It is further known from the U.S. patent specification No. 3,882,841 to limit a cylindrical combustion chamber by attaching a heat-resistant body with underlying insulation to a piston and also to a cylinder head. The heat-resistant body is in this case formed for attachment in a plurality of dovetail grooves in the piston and in the cylinder head, respectively. A locking force keeping the parts together is provided by a plurality of keys thrust in radially. The solution is complicated and therefore also expensive. Furthermore, it is difficult with available technique to form the heat-resistant body in a ceramic material with high strength.

Against the background mentioned above, the present invention has the object of forming wall portions for limiting the combustion chamber, said wall portions having good heat-insulating capacity, as well as good strength at the temperatures and loads occurring during combustion, while at the same time the parts made of ceramic material are formed simply and appropriately with regard to manufacture.

According to the invention, a heat-insulating element is disposed between the heat-resistant body and the support body, said element being of a material with a low coefficient of thermal conductivity and a low modulus of elasticity in relation to the material of the heat-resistant body and the support body, said heat-resistant body, insulating element and support body being held together substantially only by radial clamping forces.

In a piston engine formed in accordance with the invention, the combustion chamber is thus limited by at least one wall portion in which the support body, the insulating element and the heat-resistant body are of such geometric form and are of materials having such heat-conducting properties that they can coact to eliminate the need for separate attachment means. This means that local stress concentrations caused by such attachment means are avoided, and that the risk of heat losses at passages through the insulating element are completely eliminated.

In an advantageous embodiment of the invention, the whole of the surface of the engine cylinder block and at the piston facing towards the combustion chamber is covered by a circular heat-resistant body. The insulating element as well as the support body is thus protected from the mechanical and thermic loads occurring during a combustion cycle.

Figure 2:
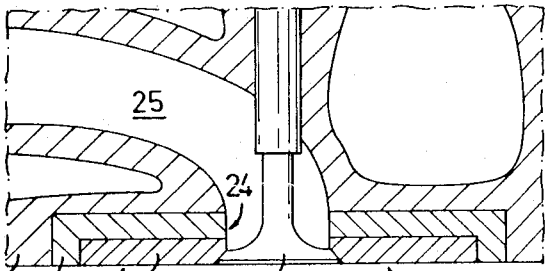
Figure 3A:
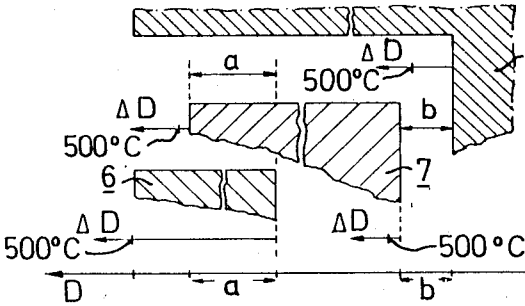
Figure 3B:
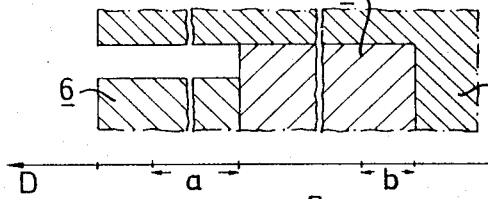
Figure 3C:
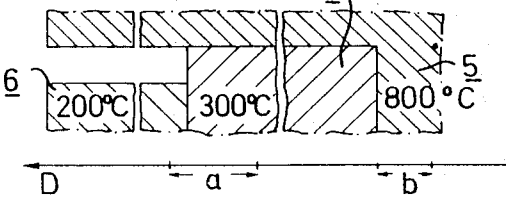

Other distinguishing features of the invention are apparent from the following description and patent claims. The description is made while referring to the appended figures, of which FIG. 1 illustrates, by means of a longitudinal section, the invention applied to one end of a piston, FIG. 2 illustrates in the same way the invention applied to a cylinder head of an internal combustion engine, and FIGS. 3*a–c* illustrate, by means of longitudinal sections, the coaction between incorporated parts for attaining the inventive clamping of a wall portion of a combustion chamber.

The right-hand half of FIG. 1 depicts a piston in a vertical section through the gudgeon pin bearing, while the left-hand half is a vertical section at right angles to the first section. The piston comprises a piston body 1 and a piston crown 2. The piston crown 2 in turn comprises a support body 3 for taking up forces, an insulating element 4 and a heat-resistant piston top 5. Each of said members can be made in one or more pieces. The support body 3 exemplified in FIG. 1 is formed as a cylindrical portion 6 with a bottom 8 by which the support body 3, coacting with a locating shoulder, rests on the upper end of the piston body 1 and is attached thereto by a number of bolts 12, only one being shown. The insulating element 4 engages in the cylindrical portion 6 of the support body 3, said insulating element also having the form of a cylindrical portion 7 provided with a bottom 9, the open end of the cylindrical portion facing upwards, the piston top 5 engaging therein. The piston top is formed with a flange and a substantially centrally situated annular depression 10 constituting part of a combustion chamber in a diesel engine of the direct-injection type.

On a level with the bottom 8 of the support body 3 there is a piston ring groove 13 in the support body 3. Remaining piston ring grooves are not shown in the figure, but they can either be placed in the support body 3 above the groove shown or in the piston body 1 below the illustrated groove 13. There is an air gap 14 arranged at the cylindrical surface of the piston between the support body 3 and the flange of the piston top 5. The air gap 14 heat-insulates the support body 3 from the piston top 5 and makes it unnecessary for the insulating element 4 to constitute a portion of the cylindrical surface of the piston. The insulating element 4 is thereby protected from contaminations and pressure loads during combustion.

The insulating element 4 and the piston top 5 are attached to each other and to the support body 3 by the insulating element 4 and its cylindrical portion 7 being a shrink fit in the cylindrical portion 6 of the support body 3, whereby also the piston top 5 is kept clamped in the cylindrical portion 7 of the insulating element 4. How the clamping forces acting in this case are provided will be described later while referring to FIG. 3.

FIG. 2 depicts a cylinder head 20 provided with an inventive heat-insulating insert 21. This insert covers the whole of the portion of the cylinder head 20 constituting part of the limiting walls of the combustion chamber. Similarly to the piston structure according to FIG. 1, the insert 21 comprises a heat-insulating element 22 and a heat-resistant body 23. The heat-insulating element 22 is formed as a plate with a circular bottom hole in which the heat-resistant body is fitted in the form of a circular plate 23. Both the heat-resistant plate 23 and the bottom of the insulating element 22 are formed with holes 24 for a fuel injection nozzle and inlet and outlet ducts 25, of which only a hole for one duct is illustrated in FIG. 2. Seats for valves 26 are also formed in the heat-resistant plate 23, only one valve and one seat being shown. As previously mentioned, the plate 23 is inserted into the insulating element 22. The insert member 21 thus formed, with the heat-resistant plate 23 facing outwards, is accommodated with a shrink fit in a support body 27, in this case consisting of the cylinder head 20. The embodiment enables the heat-resistant plate 23 to protect the insulating element 22 from being directly subjected to mechanical loads during combustion.

In an alternative embodiment, the support body 27 can be formed as a separate plate element which is attached by bolts to the actual cylinder head. As with the joint illustrated in FIG. 1, the shrink fit provides clamping forces between the support body 27 and the insulating element 22 as well as between the insulating element 22 and the heat-resistant plate 23.

The example illustrated in FIGS. 3*a–c* relates to the coaction of the piston top 5, insulating element 4 and support body 3 at the upper left-hand corner of the piston according to FIG. 1. The diameters of said details at different temperatures are indicated on a scale denoted by D in the respective figures.

FIG. 3*a* illustrates the diameter relationships between the heat-resistant body 5, the cylindrical portion 7 of the insulating element 4 and the cylindrical portion 6 of the support body 3 at a temperature of 0° C. It will be seen therefrom that the original outside diameter of the cylindrical portion 7 of the insulating element exceeds the inner diameter of the cylindrical portion 6 of the support body by a distance a which is greater than the distance b by which the inner diameter of the insulating element exceeds the outside diameter of the heat-resistant body 5.

In FIG. 3*a*, a scale denoted ΔD originates at each of the coacting radial surfaces. The location of the origin of each scale indicates the size of the diameter in question at 0° C. (not denoted). A denotation 500° C. indicates the size of the diameter of the detail in question at this temperature. On each scale there is thus illustrated the diameter variation to which the detail in question is subjected when heated.

In may be seen from FIG. 3*a* that the support body 3 (portion 6) in the example shown clearly has the greatest coefficient of thermal expansion, that the heat-resistant piston top 5 has a coefficient which is about a third of that of the support body 3 (portion 6), and that the coefficient of the insulating element 4 (portion 7) is only a third of that of the heat-resistant piston top 5.

When assembling the details in question, the heat-resistant body 5 can be inserted in the insulating element 4 (portion 7) without difficulty, due to the difference in diameters. The insert member thus formed is thereafter inserted in the support body 3 (portion 6) which has been heated to a temperature such that its diameter has increased by an amount exceeding the dimension a according to FIG. 3*a*. This signifies that in the example shown the support body 3 (portion 6) must be heated to at least 300° C. before said diameter increase a is achieved.

When the support body 3 (portion 6) cools, resulting in a corresponding shrinkage, the insert member becomes clamped in the support body 3 (portion 6). The insulating element 4 (portion 7) has a low modulus of elasticity as compared with the support body 3 (portion 6) and the heat-resistant body 5, enabling the insulating element 4 (portion 7) to yield to the other parts in the joint. Furthermore, the insulating element 4 (portion 7) has a compressive strength which is sufficient to transfer the clamping forces of the support body 3 (portion 6) to the heat-resistant body 5 without the insulating element 4 (portion 7) being crushed. The shrinkage of the support body 3 (portion 6) thus results in that the insulating element 4 (portion 7) is clamped firmly between the two other parts, and that the heat-resistant body 5 is thereby clamped into the insulating element 4 (portion 7). This signifies that the outside diameter of the insulating element 4 (portion 7) has decreased by the dimension a after cooling, while its inner diameter has decreased by a dimension at least exceeding the dimension b.

The clamping provided, which in FIG. 3*b* is depicted at a temperature of 0° C., must stand prevailing loads both at low temperature (engine starting in the cold) and at high temperature during combustion in the engine. As will be seen from FIG. 3*a*, the support body 3 has a considerably greater thermal expansion than the heat-resistant body 5, and the expansion of the insulating element 4 can be ignored in this connection. This signifies that the grip between the parts in the joint depicted in FIG. 3*b* increases during cooling, while it decreases during heating. When heating up to the highest temperature the parts can attain, the support body 3 is not allowed to expand so much that the grip between the insulating element 4 (portion 7) and the two other parts becomes insufficient to hold the parts together.

Manufacturing tolerances should also be considered in the dimensioning of the parts. In the individual case, for heating to the highest temperatures reached by the parts, the following condition is applicable:

$$a - b - \Delta D_{supporting\ body} + \Delta D_{heat\text{-}resistant\ body} > minimum\ grip.$$

This signifies that a least necessary grip (minimum grip) may not be fallen below when the grip (a−b) prevailing at room temperature at decreased during heating by the support body expanding more than the heat-resistant body ($\Delta D_{support\ body} > \Delta D_{heat\text{-}resistant\ body}$).

FIG. 3*c* illustrates the diametrical dimensions of the different parts along the diameter scale at the temperatures which are denoted on the respective details. The denoted values are representative of the temperatures which the different parts attain during combustion in a diesel engine. As an example of suitable materials in the respective parts can be mentioned:

Heat-resistant plate 5—HIP (Hot Isostatic Pressing) silica nitride $Si_3N_4$ Insulating element 4—Aluminium titanate $Al_2TiO_5$ Support body 3—Martensite valve steel X45CrSi9.

Other materials are also conceivable within the scope of the invention idea, for an inventive piston structure subjected to severe loads. For the cylinder head structure and for a cylinder lining structure the material requirements are not equally as demanding, since in these cases there are only compressive loads, and furthermore good cooling is available. What is essential is however that the modulus of elasticity of the insulating element 4 at least falls below 50% of that of the support body 3 and of the heat-resistant body 5. Furthermore, the coefficient of thermal expansion for the insulating element 4 should at least fall below 20% of that of the support body 3.

The support body 3 can also be made in other materials, e.g. cast iron when the support body 3 is utilized in the cylinder head or lining. What is essential is however that the coefficient of thermal expansion is as low as possible, whereby the shrink fit is ensured with the least possible cooling requirement of the support body 3. Of course the strength of the material must also be retained at a sufficiently high level at the temperatures the support body 3 can reach during combustion in the engine.

The described embodiment examples must not be regarded as limiting for the invention, but within the scope of the following patent claims it can be modified into alternative embodiments. It is thus also conceivable within the inventive concept for the support body 3 to be formed for pressing radially from within against the insulating element 4, which in turn is pressed against the radially exterior heat-resistant body 5.

What I claim is:

1. A piston engine having at least one cylindrical combustion chamber having a cylinder axis, said combustion chamber being limited by at least one wall portion comprising a support body with at least one mantle surface radially directed relative to the cylinder axis, said surface facing a corresponding radially directed surface on a heat resistant body limiting the combustion chamber; and a heat-insulating and force-transmitting substantially cylindrical cup disposed between the heat-resistant body and the support body and fully separating said bodies from any contact, said cup having a recess with a bottom wall having surfaces which face axially relative to said cylinder axis and a substantially cylindrical side wall having radially directed surfaces in engagement with the radially directed surface on said support body and with the radially directed surface on said heat-resistant body, said cup being of a material of low coefficient of thermal expansion and a low modulus of elasticity relative to the material of said heat-resistant body and to the material of said support body, said bodies and said cup being held together only by radial clamping forces acting at said radially directed surfaces with the heat-resistant body being contained within said recess.

2. A piston for an internal combustion engine, incorporating at one end a heat-resistant body for partly limiting a combustion chamber in an internal combustion engine, a support body for supporting said heat-resistant body, said bodies each having a mantle surface radially directed relative to the lengthwise axis of the piston, said surfaces facing each other, characterized in that a heat-insulating element is disposed between said bodies, fully separating said bodies from any contact, said element being shaped essentially as a cylindrical cup having a recess with a bottom and a substantially cylindrical side wall and being of a material having a lower coefficient of thermal expansion and a lower modulus of elasticity than the material in either one of said bodies, the bodies and the element being held together only by radial clamping forces with the heat-resistant body being contained within said recess.

3. A piston engine with at least one cylindrical combustion chamber having a cylinder axis, said combustion chamber being limited by at least one well portion comprising a support body with at least one mantle surface radially directed relative to the cylinder axis, said surface facing a corresponding surface on a heat-resistant body limiting the combustion chamber, characterized in that a heat-insulating and force-transmitting element is disposed between the heat-resistant body and the support body, fully separating said bodies from any contact, said element being shaped essentially as a cylindrical cup having a recess with a bottom and a substantially cylindrical side wall and being of a material with a low coefficient of thermal expansion and a low modulus of elasticity in relation to the material of the heat-resistant body and the support body, and that the heat-resistant body, the insulating element and the support body are held together only by radial clamping forces transmitted through said insulating element with the heat-resistant body being contained within said recess.

4. A piston engine as claimed in claim 1, characterized in that the insulating element is made from aluminium titanate, and that the heat-resistant body is made from hot isostatic pressed silicon nitride.

5. A piston engine as claimed in claim 3, characterized in that modulus of elasticity of the insulating element is less than 50% of that for the heat-resistant body.

6. A piston engine as claimed in claim 5, characterized in that the insulating element has a coefficient of thermal expansion falling below 20% of that of the support body.

7. A piston engine as claimed in claim 6 including a cylinder head, characterized in that all of the wall portion of the cylinder head is covered by the heat-resistant body.

8. A piston engine as claimed in claim 7, characterized in that said cup-shaped insulating element lies inside a cylindrical surface formed on the support body.

9. A piston engine as claimed in claim 8, characterized in that a grip holding together the support body, the insulating element and the heat-resistant body exceeds a resulting difference in heat expansion between the support body and the heat-resistant body when these are heated to temperatures prevailing during combustion in the engine.

* * * * *